United States Patent [19]

Böhringer et al.

[11] 3,951,761

[45] Apr. 20, 1976

[54] METHOD AND APPARATUS FOR ELECTRO-PLATING STRIP CONTACTS

[75] Inventors: Werner K. Böhringer, Heilbronn-Frankenbach; Horst B. Goller, Obersulm-Willsbach; Hans K. Kollmar, Lowenstein; Hans A. Mössinger, Beilstein; Rudolph H. Zeltner, Obersulm-Willsbach, all of Germany

[73] Assignee: Bunker Ramo Corporation, Oak Brook, Ill.

[22] Filed: Jan. 31, 1975

[21] Appl. No.: 545,812

[52] U.S. Cl. ..... 204/15; 118/505; 204/198; 204/297 W

[51] Int. Cl.[2] ..... C25D 5/02; C25D 17/04; C25D 17/06

[58] Field of Search ..... 204/15, 28, 297 W, 297 R, 204/198–202, 206–211, 224 R, 194; 118/503–505, 406, 426

[56] References Cited

UNITED STATES PATENTS

| | | | |
|---|---|---|---|
| 1,950,096 | 3/1934 | Yeager | 204/297 R |
| 2,129,868 | 9/1938 | Pearson | 204/297 W |
| 2,245,335 | 6/1941 | Frey | 204/297 W |
| 2,326,707 | 8/1943 | Thomas et al. | 204/199 |
| 3,432,423 | 3/1969 | Zavitz | 204/297 R |
| 3,701,726 | 10/1972 | Laboue | 204/222 |

FOREIGN PATENTS OR APPLICATIONS

| | | | |
|---|---|---|---|
| 463,480 | 3/1950 | Canada | 204/297 W |

*Primary Examiner*—T. M. Tufariello
*Attorney, Agent, or Firm*—Fred Fisher; F. M. Arbuckle

[57] ABSTRACT

The following specification describes a contact electroplating process and apparatus in which a web carrying the contacts is attached to a plastic carrier strip formed of modules in end to end relationship and then wound on a plating reel. Projections on the strip register with pilot holes in the web to attach the strip to the web. Teeth on the strip enable the strip to be properly indexed for attachment to the web and the projections and a rib on one surface of the strip are nestingly received between the teeth on adjacent turns of the strip and web as they are wound in a stack on the plating reel. The plating reel has a bushing for establishing an electrical connection to the contacts which is easily sealed by a simple nut mounting the reel on an arm or beam for immersion in a plating bath. After plating, the stacked contacts and strip are easily separated and wound on separate reels permitting reuse of the strip, and plating reel, while the contacts are in condition for subsequent operations.

26 Claims, 13 Drawing Figures

STATION III

STATION II

METHOD AND APPARATUS FOR ELECTRO-PLATING STRIP CONTACTS

BACKGROUND OF THE INVENTION

1. Field of the Invention

This invention relates in general to electroplating electrical contacts and more particularly, to improved method and apparatus for batch plating stamped electrical contacts attached to a web.

2. Summary of the Prior Art

In prior art arrangements for electroplating stamped contacts, a web having the contacts attached thereto is passed into a plating bath through complicated and expensive equipment which controls the passage of the contacts into, through and out of the bath. While this arrangement may be satisfactory for large production runs, it is not feasible or economic for use with relatively small batches of contacts. Alternatively for smaller batches having varied numbers of contacts, the web may be severed into different portions and manually stacked on appropriate carrying equipment for immersion in a conventional plating tank. Extensive manual handling however, renders this type of operation relatively time consuming and also expensive.

In addition, the plating is also often applied to unnecessary portions of the contacts and/or web or associated apparatus so that considerable precious metal may be lost unless expensive equipment is provided to avoid this condition.

SUMMARY OF THE INVENTION

In the present invention, the metal web together with the attached contacts and an attached carrier strip of insulating material are wound on a plating reel of insulating material as the web and contacts leave the punch press at which the contacts are formed. The carrier strip is formed of a plurality of modules attached in end to end relationship and covers both surfaces of the metal web when the web and strip are wound on the plating reel. The reel is then placed on a shaft extending from a conventional swinging arm or from a cross-beam for immersion in a plating bath with the strip minimizing unnecessary plating. With the modular arrangement of the strip, the strip is easily varied in accordance with the number of contacts or length of web in a batch.

To insure the proper positioning and support of the contacts on the plating reel, the plastic carrier strip has registering grooves and projections on opposite sides thereof. The strip is automatically attached to the metal web as the strip is unwound from its reel by means of spaced projections on the strip registering with spaced perforations in the web as the web leaves the press. Teeth on the strip are indexed by gear teeth to ensure registration, and the grooves and teeth on the strip automatically engage corresponding formations on the plating reel while winding the first layer on the reel. Thereafter corresponding formations in each overlapping turn of the strip engage to guide and locate the web and contacts on the reel in a predetermined position.

The contacts arranged in a stack project from one edge of the web and the carrier strip when wound on the plating reel and when wound to a desired position corresponding to the selected batch or web length, the reel is removed from its stand and mounted for plating. An easily sealed electrical connection is provided to the metal web by means of an insert or bushing on the reel engaging the conventional shaft at the plating tank or bath. The shaft has threaded ends engaged by a plastic nut to secure the reel on the shaft, and to seal the bushing and shaft so that only the projecting contacts or a desired portion thereof are plated when the contacts are placed in an electroplating bath and the current applied from the sealed bushing to the contacts. The reel thus accommodates stacks of considerable different size.

Thereafter, the stacked plating reel is simply removed from the plating bath and mounted for rotation. The web and attached carrier strip are partially separated and attached to respective other reels located on a common support for automatically disconnecting the plastic carrier strip from the metal web in response to the simple rotation of the attached other reels in turn rotating the stacked plating reel. The web and strips are each automatically separated as their paths follow different tangent lines to the stacked contacts and each is wound on the respective attached reels with the contact web being interleaved by a paper tape so that it is in condition for sale or subsequent operations. The plastic carrier strip wound on its reel is then ready for reuse of the strip for attachment to another web and the plating reel is also available for reuse.

It is therefore a primary object of the present invention to provide an improved and/or more economical method and apparatus for plating electrical contacts.

Other objects and features of the present invention will become apparent upon examination of the following specification and claims together with the drawings.

DESCRIPTION OF THE INVENTION

Figures 1, 2, 3, 4, 5:
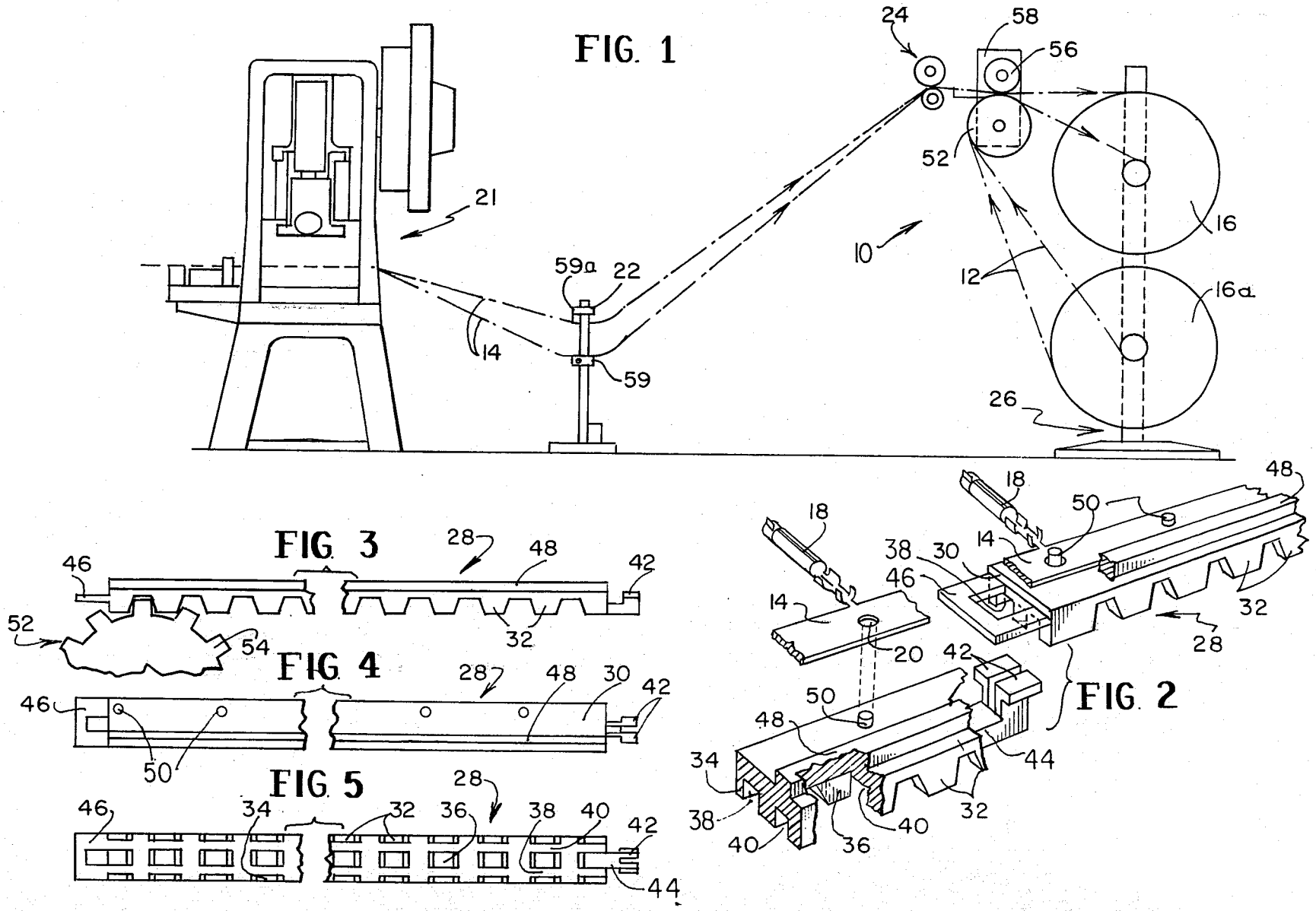
FIG. 1 is a schematic illustration of the method and apparatus for attaching a plastic carrier strip to a metal web carrying contacts and winding the strip and web upon a reel.
FIG. 2 is an isometric view of a portion of the carrier strip segments and the metal web.
FIG. 3 is a side elevational view of one of the carrier strip segments.
FIG. 4 is a top elevational view of the plastic carrier strip segment shown in FIG. 3.
FIG. 5 is a bottom elevational view of the plastic carrier strip segment shown in FIGS. 3 and 4.
Figure 6:
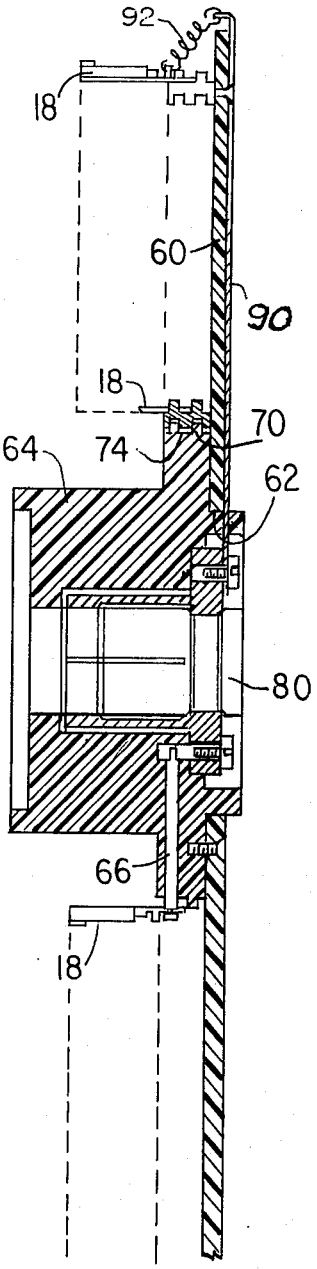
FIG. 6 is a sectional view of the plating reel diagramatically illustrating the carrier strip and web wound thereon.
Figure 7:
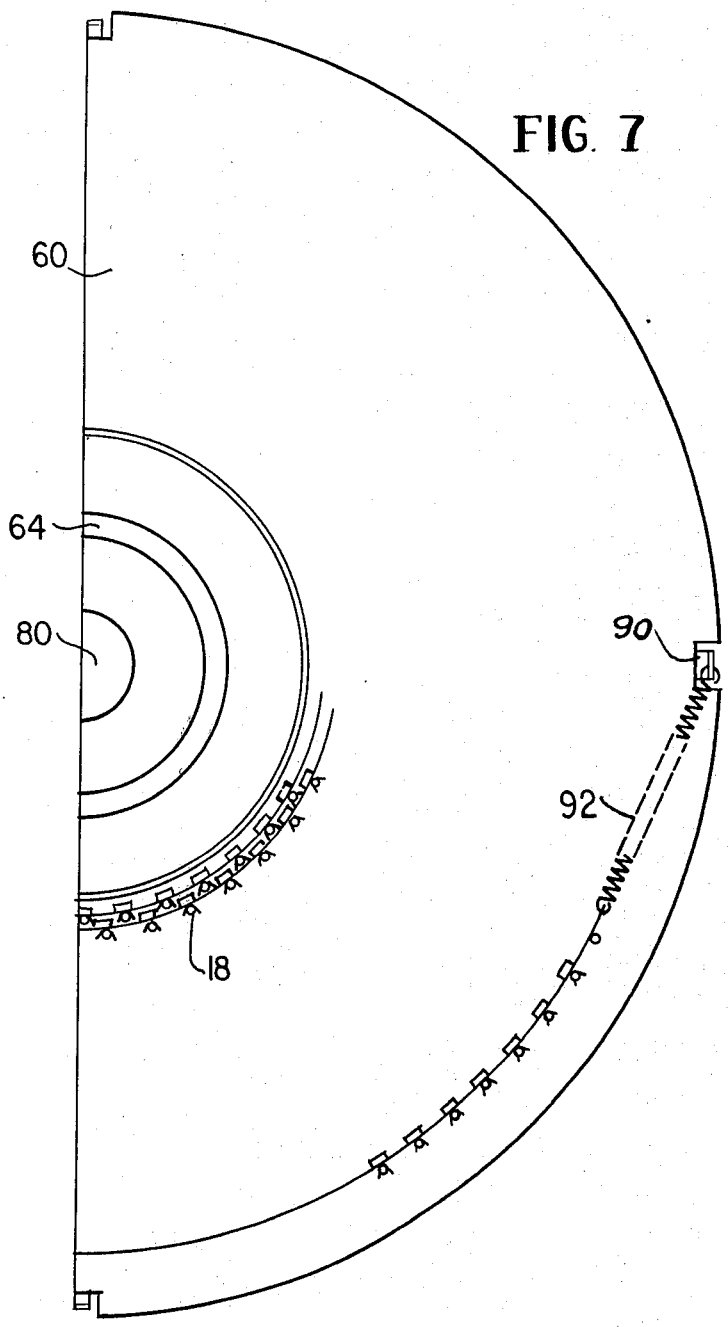
FIG. 7 is a partial front elevational view of the plating reel diagramatically illustrating the assembled carrier strip and web thereon.

In FIG. 1, apparatus generally indicated by the reference character 10 is shown for attaching a plastic electrically insulating elongate or elongated carrier strip 12 to a metal web 14 and winding the carrier strip 12 and web 14 on a plating reel 16.

The web 14 has a plurality of spaced contacts 18 integrally formed thereon together with correspondingly spaced perforations or pilot holes 20, as seen in FIG. 2, by a punch press 21. The contacts 18 project generally laterally from one edge of the web 14 and the contact axis is generally perpendicular or transverse to the longitudinal axis of the web 14. The web 14 passes through a conventional sensing station 22, which senses the slack in the web between the punch press 21 and a guide and attachment station 24, where the web 14 is attached to the carrier strip 12.

As seen in FIG. 1, the plating reel 16 is rotatably carried on a shaft adjacent the upper end of a take-up stand 26. A second reel 16*a*, identical to reel 16, is rotatably carried adjacent the lower end of the stand 26 and the carrier strip 12 is unwound from reel 16*a* for attachment to the web 14 at station 24.

The carrier strip 12 comprises a plurality of longitudinally extending segments or elongated modules 28 formed of electrically insulating plastic. As best seen in FIGS. 2, 3, 4 and 5, each module 28 comprises a generally planar rectangularly shaped thin sheet 30 with a series of projections or teeth 32, 34 and 36 integrally formed thereon projecting perpendicularly from one face of the strip 30. Teeth 32 and 34 are spaced parallel to the longitudinal axis of each sheet 30 and along respective opposite longitudinal edges or margins of the sheet. Teeth 36, each somewhat wider than teeth 32 and 34 but of the same height and longitudinal dimensions, are integrally formed on sheet 30 and aligned with respective ones of all of the teeth 32 and 34. Teeth 36 are located intermediate each tooth 32 and 34 and project in the same direction as teeth 32 and 34, from one face of sheet 30. As seen in the drawings, the teeth 32, 34 and 36 therefore define spaced grooves 38 and 40 therebetween.

A pair of spaced L shaped spring tabs 42 are integrally formed on an end intermediate tooth 36 of each segment 28 by means of an arm 44 extending longitudinally from adjacent the lower portion of the end margin of the end tooth 36. Each tab 42 has an integrally formed leg generally coplanar with sheet 30 and extending in opposite directions for overlapping engagement with the side legs of a U shaped loop 46 at a respective opposite end of an adjacent segment 28.

The loop 46 is located just below the level of sheet 30 and has a back leg and side legs whose ends opposite the back leg are integrally formed at an end of each sheet 30 to form a closed loop at the end of each module opposite tabs 42. Thus, the tabs 42 at one end of each module 28 can be pressed together for passage through the closed opening defined by loop 46 and on release of the tabs, the horizontal legs of the tabs overlap the legs of the loop with the vertical arm of the tabs passing through the loop opening to hook or secure the modules or segments 28 in end to end longitudinally extending relationship and form the carrier strip 12. Thus the tabs 42 and loop 46 constitute means for securing the modules in sequence to form the elongate carrier strip in a length corresponding to the web length and number of contacts.

Each segment 28 also has a projection or longitudinal rib 48 of generally rectangular cross section extending longitudinally of the module and formed on the opposite surface of the sheet 30 from teeth 32, 34 and 36. The rib 48 is located intermediate opposite longitudinal edges or margins of the module and is aligned with and dimensioned in correspondence with groove 40. In addition, the opposite surface of each sheet 30 has formed thereon a plurality of spaced projections 50 corresponding generally in size, shape and spacing to the pilot holes 20 in web 14 for engagement therein. It will be noted that the projections 50 are located intermediate the rib 48 and the margin of the strip adjacent teeth 34 so that they are aligned with groove 38 and correspond to the depth and width of the groove 38 while the spacing between projections 50, rib 48 and the opposite longitudinal margins of each sheet is dimensioned to receive teeth 32, 34 and 36 therebetween. The number of projections 50 is actually less than the number of pilot holes and are spaced longitudinally coincident with alternate teeth so that when teeth 32 and 36 straddle respective projections 50, relative lateral or sidewise shifting is resisted. The projections 50 are somewhat elliptical in cross section so that they partially deform to engage in holes 20 for securely holding the web attached in a predetermined relationship to the strip or module.

As previously mentioned, the carrier strip 12 is provided with a longitudinally extending rib 48 on one side or face and longitudinally extending spaced grooves 38 and 40 on the opposite side or face defined by the series of teeth 32, 34 and 36 with the space or groove 40 between teeth 32 and 36 in registration and corresponding to the width and depth of the rib 48 and with the space or groove 38 between teeth 34 and 36 in registration and corresponding in width and depth to the projections 50 respectively. The strip rib 48 therefore engages or is matingly received in the groove 40 when the carrier strip segments are wound in end to end relationship on the reels 16 or 16*a* with the projections 50 engaging or nestingly received in groove 38. Likewise, teeth 36 are then engaged or nestingly received between rib 48 and projections 50 while one series of edge teeth engage the face of rib 48 opposite teeth 36 and the other edge teeth engage the face of projections 50 opposite teeth 36 so that the strip is securely held against sidewise or lateral movement perpendicular to the longitudinal axis of the strip and the projections, ribs, grooves and teeth constitute formations or enabling means for supporting the strip and web in predetermined position in a plating bath.

The guide and attachment assembly 24 includes a plastic gear 52 indicated schematically in FIGS. 1 and 3, having teeth 54 for engaging between the longitudinally spaced teeth. The guide and attachment assembly 24 also includes guide rollers for the web and carrier strip together with opposing rollers such as 56 for pressing the web perforations 20 into snap fit engagement with projections 50 to secure the web 14 to the carrier strip 12, while the teeth 54 serve to index the strip 12. It will be understood that the position and number of rollers shown is only exemplary and can be varied as desired. The gear 52 together with the rollers and the reel 16 at the upper position of the take-up stand 24 are driven by a common motor indicated by box 58 through conventional gear reduction system, if desired, with the reel 16 being conventionally operated by a pulley and belt from the motor to draw the strip 12 from reel 16*a*. The web may of course also be indexed.

The sensing unit 22 senses the position of the web 14 to ensure synchronization between the punch press cycle and the operation of motor 58. Thus, with the web 14 in the lowermost position as shown in FIG. 1, a sensing switch 59 at the lower position of the sensing station or synchronization unit 22, feels the web position and initiates operation of motor 58. If the web and carrier strip are being wound on reel 16 at a rate faster than the operation of the press 21, the slack in the web will decrease and it will move to the uppermost position as shown in FIG. 1 to operate another switch 59*a* at the synchronization unit 22 for terminating operation of motor 58, until the press cycle provides sufficient web slack to again enable motor operation. The gear 52 and associated rollers ensures that the carrier strip 12 pulled from reel 16*a* by the rotation of reel 16 under control of motor 58 remains synchronized with the web despite the changes in the position of carrier strip 12 as it unwinds from the respective reel 16*a* at the lower pay-off position on stand 26.

The reels 16 and 16*a* as seen in FIGS. 6–9, each comprise a plastic electrically insulating annular plate 60 defining a central opening 62 in which one axial end of an annular plastic hub 64 is seated. The hub 64 has a radially outwardly extending shoulder or flange 66 seating against the front radial face 68 of the disc or plate 60.

Flange 66 extends axially from the plate 60 for a distance corresponding to the width of strip 12 and web 14 whereafter the periphery of hub 64 is reduced for the major axial portion of the hub. Formed along the outer periphery of flange 66 are a pair of axially spaced circumferentially extending ribs 70 and 72 in turn defining three axially spaced circumferentially extending recesses 74 for receiving a respective one of the three series of strip teeth 32, 34 and 36 and corresponding in size, shape and axial spacing to the teeth so that the strip 12 and web 14 together with the attached contacts 18 wrap or wind around the hub flange 66. Spaced fasteners such as 76 extending through plate 60 into flange 66, secure the hub 64 to the plate 60.

The hub 64 also has a central opening 78 for receiving either a shaft at either the upper or lower position of the stand 26. The opening 78 also receives either a horizontal shaft 80 on vertical swinging plating arm 82, seen in FIG. 8, or a vertical shaft 80*a* on horizontal cross beam 82*a*, seen in FIG. 9, after the reel 16 is removed from the stand 26. Circumferentially spaced fasteners 84 secure a metal bushing 86 in an enlarged position of the central opening 78 of the hub located at an axial position adjacent plate 68. The bushing 86 also has a central opening therein registering with opening 78 and projecting axially from the bushing 86 into opening 78; and are circumferentially spaced spring fingers 88. The spring fingers 88 extend into opening 78 adjacent the periphery thereof for the purpose of ensuring electrical engagement between the shaft 80 of plating arm 82 or shaft 80*a* of cross-beam 82*a* respectively and the bushing 86.

Fastened to the rear radial face of bushing 86 and plate 60 are a plurality of circumferentially spaced radially extending arms such as 90 which extend through respective sealed openings or passageways formed in the radially outwardly spaced portion of the hub 64 engaging the plate central opening 62. The arms 90 extend an electrical connection toward the radial outward edges of the plate 60 from the bushing 86. An L shaped bend at the respective outer extremities of arms 90 extending into respective openings or recesses adjacent the periphery of plate 60 is provided for the purpose of connecting and supporting one end of a spring 92 whose other is extended to the web 14 after the web 14 and the strip 12 are wound on the hub flange 66. Thus, a selected variable web length and number of contacts are secured to the reel 16.

In addition, one of the metal fasteners 84 securing the bushing 86 to the hub 64 has a threaded radially extending opening therein which receives the threaded end of a radially extending pin 96. Alternatively, the pin 96 may be press fit in the radially extending opening of the fastener. Pin 96 projects radially outwardly of the hub flange 66 through a sealed passageway at an axial position corresponding with rib 70 which is omitted from the corresponding portion of the periphery of hub 66. The projecting end of pin 96 is thus generally of the same size as the strip projections 50 and it passes through the initial overlapping perforation or pilot hole opening 20 in web 14 when the reel 16 is in the upper position on stand 26 after the web 14 together with strip 12 are first drawn through the guide and attachment means so that the web 14 can be attached to pin 96.

After the strip 12 and web 14 are attached to the pin 96, the motor 58 is set in operation to rotate the reel 16 at the upper take-up position on stand 26. Reel 16 pulls the strip 12 from reel 16*a* while the web 14 is fed by the press 21 under control of synchronization unit 22, as explained. The pin 96 pulls the web 14 and attached carrier strip 12 through the guide and attachment means 24 with the ribs and grooves of the carrier strip in registry with respective grooves 74 and ribs 70 and 72 of flange 66. Thus the first turn of strip 12 and web 14 are wound around the flange 66 and thereafter the rib 48 and projections 50 register with each groove 38 and 40 on the opposite side of the carrier strip 12 to properly layer the strip and web on flange 66 in a spiral stack 98 with the contacts 18 projecting axially toward the end of the hub opposite plate 68.

The reel 16 usually is wound with a batch of 2,000 contacts, however, this number will depend on the number selected for the batch and the number of modules 28 in the strip are easily selected in accordance with the number in the batch. A counter at the press 21 therefore counts the cycles and after the selected number of contacts 18 are formed, the counter is arranged to shut the press off. The carrier strip modules 28 each have twenty longitudinally spaced teeth 32, 34 and 36 so that 100 modules 28 are strung together to accommodate the 2,000 contacts, since the tooth spacing corresponds to the contact and pilot hole spacing. The stack 98 is thus wound to a desired radial position relative the disc 60 and this position corresponds to the selected number of contacts or web length and the number of modules. The motor 58 and the press 21 are, of course, stopped. The web is severed at an appropriate position if it has not been completely run through the press. A spring 92 is attached to one end of a selected one of the radial arms 90 appropriately positioned relative to the termination of the web and the other end of the spring secured to the web. Additional or other means to secure the web and strip free ends may, of course, be also used. Thus the reel 16 accomodates large variations in the number of contacts in a batch run through the press since stacks 98 of considerably different size can be wound on the reel. The reel 16 is also thus removed from the stand 26 and facilely handled without the stack 98 becoming unravelled. The reel 16*a* which is usually wound with a corresponding number of modules 28 is now empty and it is moved to the upper position at the stand 26 for the purpose of receiving another stack 98.

Figure 8:
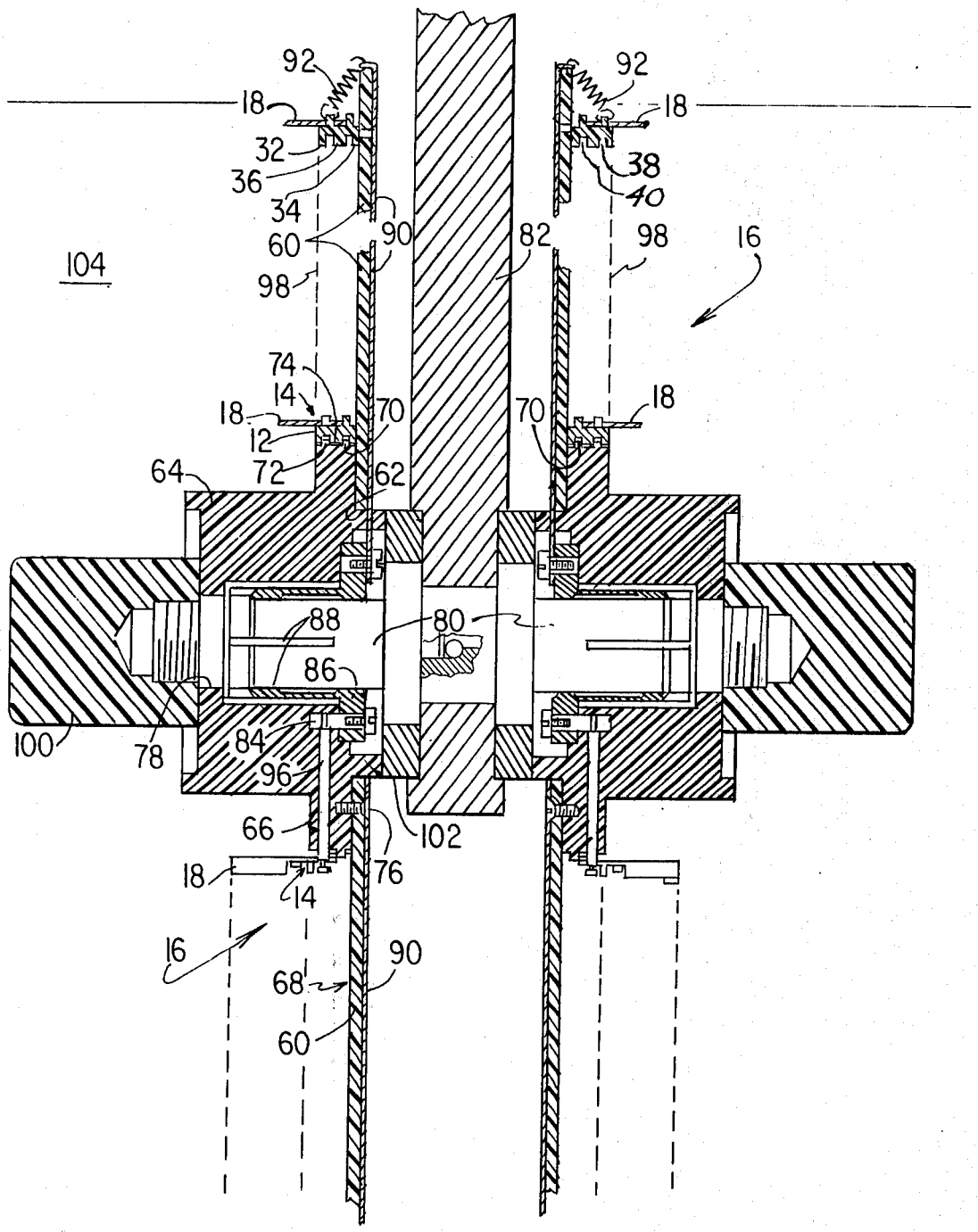
FIG. 8 is a sectional view of the reel strip and contacts mounted on a plating arm and immersed in a plating bath.
Figure 9:
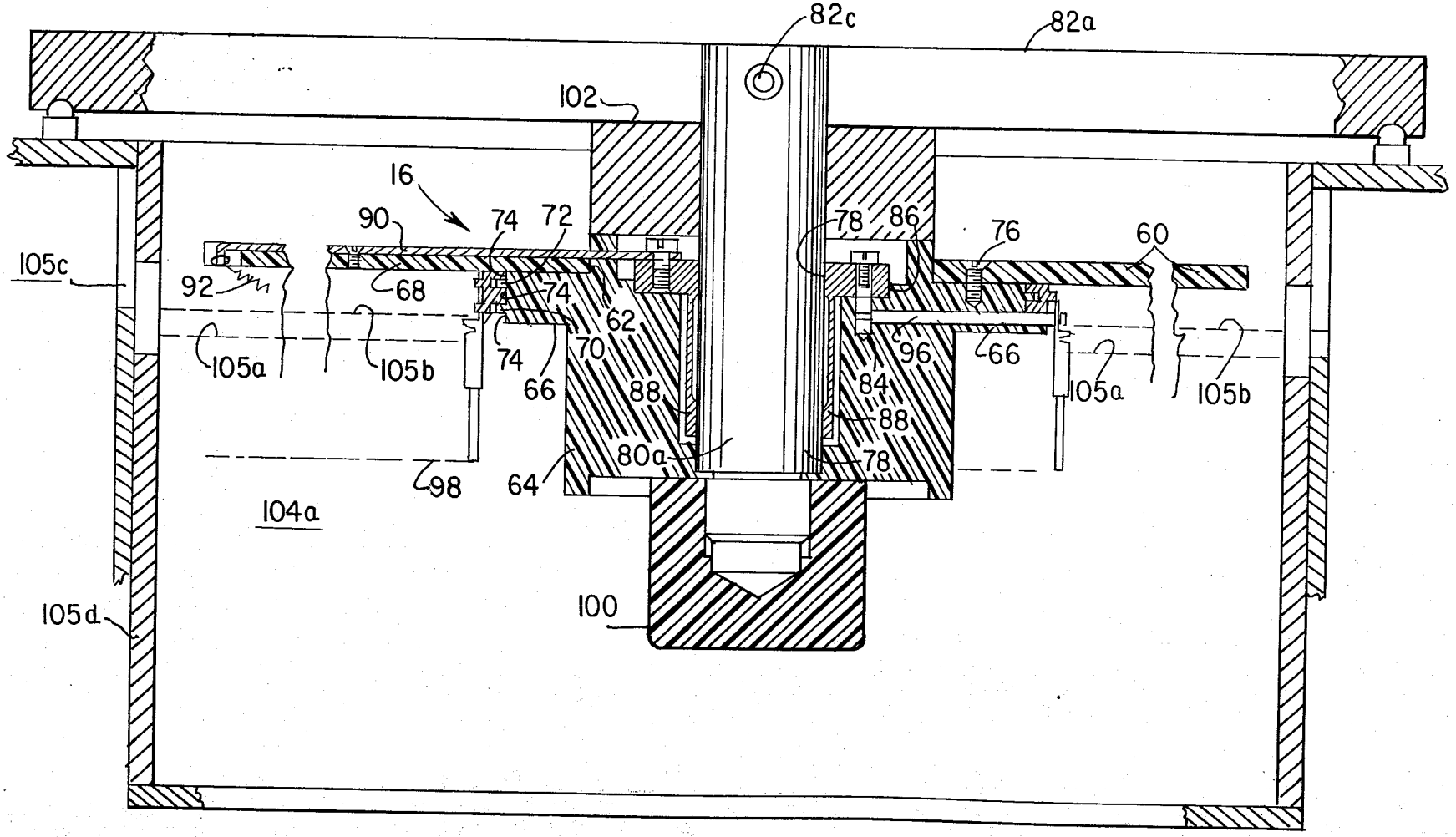
FIG. 9 is a sectional view of the plating reel, strip and contacts mounted on a cross-beam for immersion of the contacts in a precious metal plating bath.

The reel 16 with the stack 98 including the web 14, contacts 18 and attached carrier strip 12, after removal from stand 26, is mounted on a shaft 80 projecting horizontally at the lower end of an electroplating arm 82 as seen in FIG. 8 depending from a conventional transversing mechanism or on a vertical shaft 80*a* located on cross beam 82*a* as seen in FIG. 9. In the case of shaft 80, a second coaxial shaft 80, projecting from the arm 82 in the opposite direction, may receive another reel 16 carrying a respective stack 98. The reel 16 is mounted by passing the shafts 80 or 80*a* respectively through the central opening or passageway 78 in the hub and securing a plastic nut 100 over the threaded end of shaft 80 and in abutment with free axial end of hub 64. The other axial end of hub 64 overlaps bushing 86 and butts against a radial face 102 on arm 82 or cross beam 82*a* respectively to prevent the entrance of plating solution into the central passageway 78 in response to tightening of nut 100.

The arm 82 or cross beam 82*a* thus suspends the contacts 18 for immersion in a plating bath 104 seen in FIG. 8 or in a plating bath 104*a* of gold or silver seen in FIG. 9. The shaft 80 is sealed from the solution shown in FIG. 8 so that its dimensions do not change after plating, while a circuit is established from an electrode connected to arm 82 through shaft 80, fingers 88 and bushing 86 and extending through pin 96 and radial arm 90 to the contacts 18 at opposite ends of the web and to the opposing electrode through the plating solution 104. The plastic carrier strip 12 engaged with both surfaces of web 14 prevents unnecessary plating of the web. The swinging arm 82 may, of course, be conventionally traversed from one solution to another to complete the plating operation and, if desired, exposed surfaces of the arm 82 and arms 90 may be covered with a dielectric material to prevent plating thereon. In the case of precious metal plating such as gold or silver plating, the bath 104*a* is advantageous since its level is controlled as shown at 105*a* or 105*b* so that the contacts 18 depending from the reel 16 are plated only to a desired level, which may be determined through the overflow hole 105*c* in the plating tank 105*d.* One end of the plating circuit in this case may be completed through the tank and bath while the shaft 80*a* connects the other end of the circuit to the contacts as previously explained.

Figure 10:
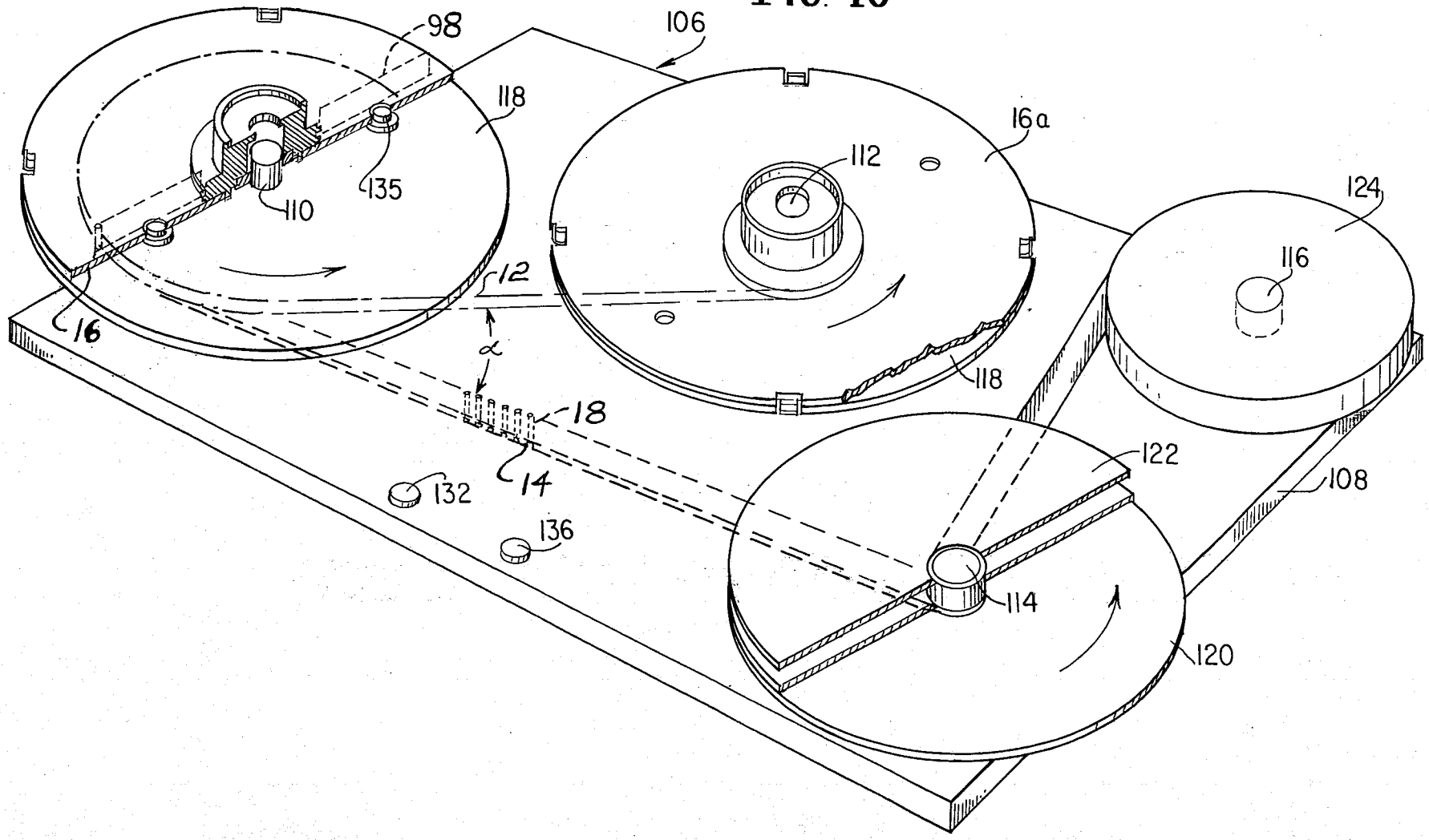
FIG. 10 is an isometric view of the apparatus for separating the metal web with the contacts from the carrier strip and for winding the web and the carrier strip on respective reels.
Figure 11:
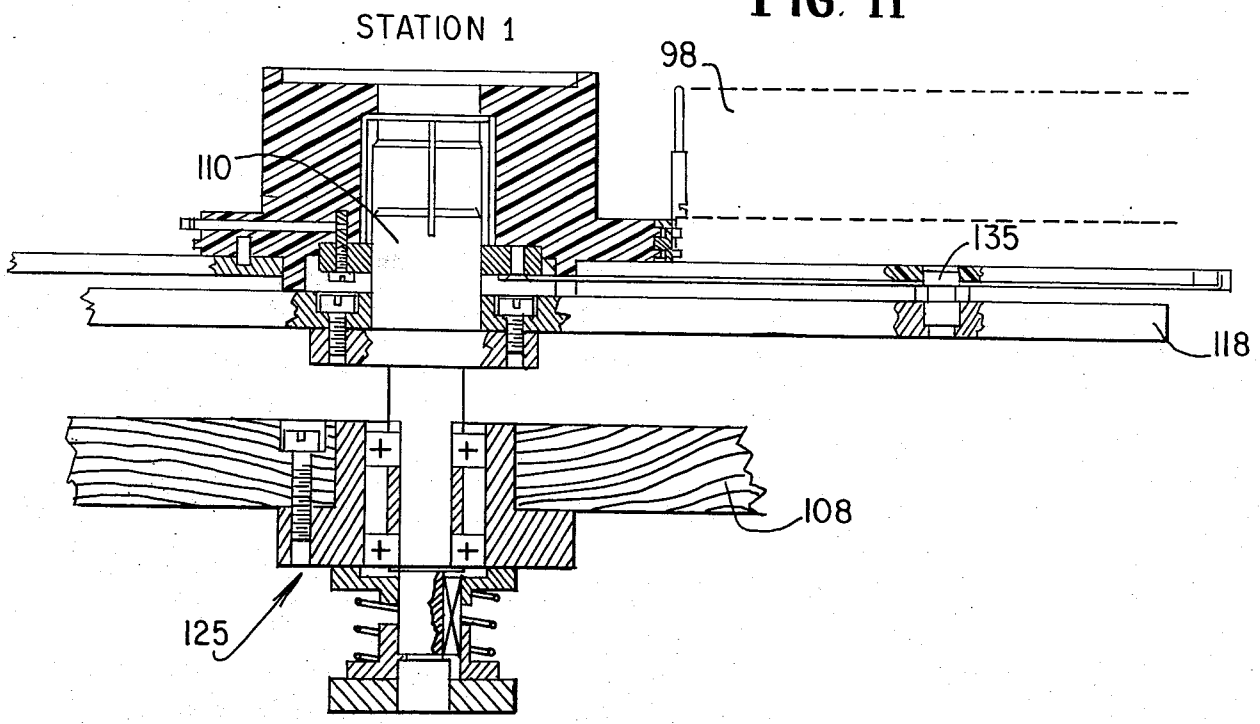
FIG. 11 is a partial sectional view of the apparatus shown in FIG. 10 on which the plating reel, metal web and carrier strip are mounted after plating.
Figure 13:
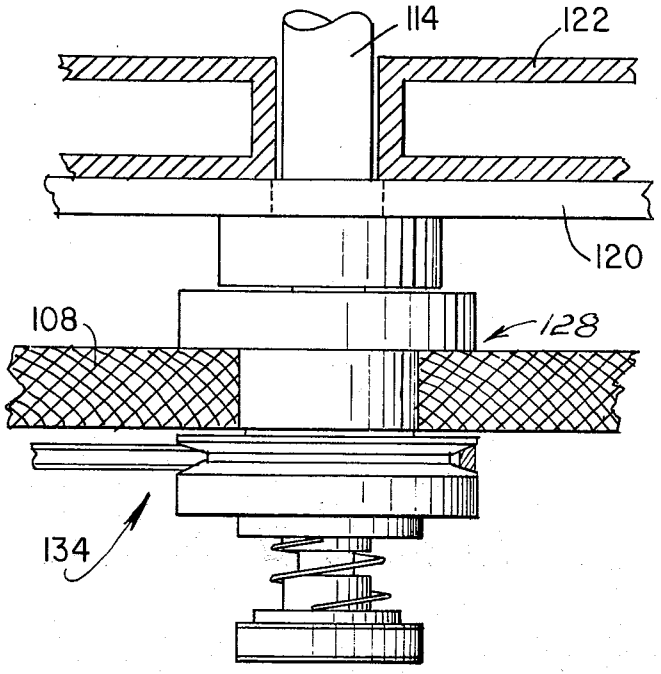
FIG. 13 is a partial sectional view of the apparatus shown in FIG. 10 for winding the metal web to separate the web from the strip.
Figure 12:
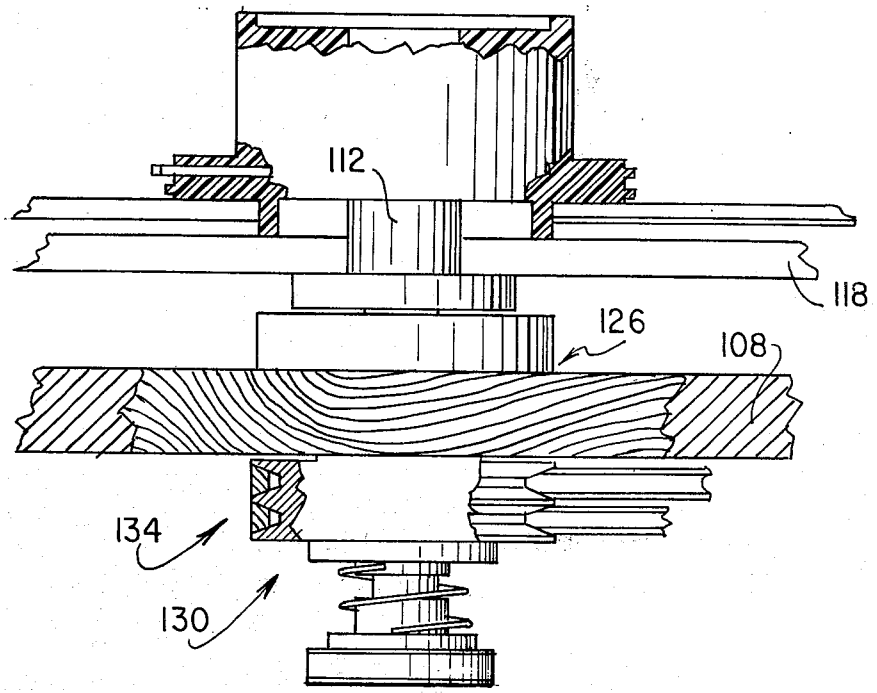
FIG. 12 is a partial sectional view of the apparatus shown in FIG. 10 for winding the carrier strip to separate the strip and web.

After the contacts 18 are plated, the reel 16 together with the stack 98, is removed from the plating bath 104 or 104*a* for disassembly of the strip 12 from the web 14 by means of the apparatus indicated generally by the reference character 106 in FIG. 10. The apparatus 106 comprises a platform or support plate 108 including a first rotatable shaft 110, a second rotatable shaft 112, a third rotatable shaft 114 and a fourth shaft 116. Each shaft 110 and 112 carries a respective disc 118 for supporting a respective reel 16 and 16*a*. Shaft 114 may have a respective disc such as 120 for supporting a conventional reel 122 for receiving the web 14 and contacts 18. A paper tape reel 124 respectively located on shaft 116 supplies a paper winding for interleaving a layer of paper between each turn of the web and contacts wound on a reel 122.

Each of the shafts 110, 112 and 114 is conventionally journalled in support 108 by conventional bearing and clutch assemblies such as 125 for shaft 110, bearing assembly 126 for shaft 112 and bearing assembly 128 for shaft 114. The shaft 112 is rotated through a pulley and belt arrangement 130 by a motor not shown which is energized by switch 132 on support 108. The motor may also be mounted on the support and a second pulley and belt arrangement 134 connected to arrangement 130 transmits power to shaft 114 to rotate shaft 114 in synchronism with shaft 112.

Reel 16, after the plating is applied to contacts 18, is mounted on disc or plate 118 with shaft 110 extending into the central opening 78 and an empty reel 16*a* is similarly mounted on shaft 112 and its associated disc. Dogs such as 135 on disc 118 engage in appropriate openings of reel 16 and 16*a* to ensure the reels rotate with the respective discs. The spring 92 is disconnected from stack 98 and the now free end of the web 14 and strip 12 are separated and extended to reel 122 and reel 16*a* respectively and secured to the respective reel 122 and 16*a*.

Power may now be applied at switch 132 to operate the motor for rotating reels 16*a* and 122 which pull the strip and web from the stack 98 and since each travels in different directions due to the spacing of shafts 112 and 114 relative each other and shaft 110, the path of the web 14 and strip 12 follow different tangent lines to the stack 98 separated by an angle $\alpha$, and the web 14 separates easily from the strip 12.

Each is now wound on the respective reel with the paper being pulled from reel 124 simultaneously with the web 14 and when the stack 98 is unwound or substantially so, power to the motor is terminated at switch 136 carried on the plate 108. The reel 16*a* with the carrier strip 12 wound thereon is now ready for placement at the lower end of stand 26 so that the strip 12 may be reused. The contacts 18 and paper wound on the reel 122 are now prepared for sale and/or subsequent operations such as separation of the contacts from the web and/or the attachment of wiring thereto.

It will be appreciated from the foregoing description that the number of modules 28 in a strip may be easily varied to accommodate a large difference in the selected number of contacts in a batch run from the press 21 and that the plating reel 16 accommodates large differences in the size of the stack 98 formed thereon by the contacts and strip.

The foregoing constitutes a description of an improved contact plating method and apparatus whose inventive concepts are believed set forth in the accompanying claims.

What is claimed is:

1. A carrier strip for carrying a web of variable length having spaced pilot holes and a plurality of spaced contacts projecting past one edge of said strip, comprising:

a plurality of elongate modules each formed of an insulating material, securing means on each module for securing each module in sequence to another module to form said carrier strip in a length corresponding to the length of said web, means on each module of said strip for engaging said pilot holes to attach each module in predetermined relationship to said web with said contacts projecting past one edge of each module, and means on each module of said strip for enabling said web to be supported in a predetermined position in a plating bath.

2. The carrier strip claimed in claim 1 in which said means enabling said web to be supported comprises projections on one surface of each module and grooves on opposite surfaces of each module in registration with the projections for engaging the projections of an overlapping module in response to winding of said strip and web in a stack.

3. The carrier strip claimed in claim 2 in which said projections comprise a plurality of series of teeth extending longitudinally along each module to define a groove therebetween.

4. For use with the carrier strip claimed in claim 3, a gear having teeth engaging in between the teeth of one plurality of teeth on each module in sequence to enable said strip to be attached in said predetermined relationship to said web.

5. For use with the carrier strip claimed in claim 3, a plating disc of insulating material having a hub of insulating material extending axially therefrom in one direction for carrying the turns of said strip and web wound in a stack of a size corresponding to the length of said web, and means in said hub for extending an electrical connection through said hub to said contacts.

6. Contact plating apparatus for plating a selected variable plurality of contacts carried in spaced positions on an elongate web corresponding in length to the selected plurality of contacts, the improvement comprising:

a plurality of elongate modules each formed of an insulating material, securing means on each module for securing each module in sequence to another module to form an elongate carrier strip corresponding in length to the web length carrying said selected plurality of contacts, means on each module of said strip for attaching said carrier strip in predetermined relationship to said web, and means on each module of said strip for enabling said web to be supported in a predetermined position in a plating bath.

7. The apparatus claimed in claim 6 in which said means enabling said web to be supported comprise means for maintaining registration between adjacent overlapping turns of said strip in response to winding of said strip and web in a stack.

8. The apparatus claimed in claim 7 in which said means for maintaining registration comprises a plurality of series of teeth extending longitudinally along each module from one surface of each module to define a groove therebetween.

9. In the apparatus claimed in claim 8, a gear having teeth engaging in between the teeth of one plurality of teeth on each module in sequence to facilitate the attachment of said strip to said web in said predetermined relationship.

10. The apparatus claimed in claim 8 in which said means for maintaining registration includes a longitudinally extending rib on the surface of each module opposing the one surface of each module for engagement in the groove defined by the teeth of a module in an adjacent turn.

11. In the apparatus claimed in claim 8, a plating disc of insulating material having a hub of insulating material extending axially from said disc in one direction for carrying the turns of said strip and web wound in a stack of a size corresponding to the web length, and means in said hub for extending an electrical connection through said hub to said contacts.

12. In the apparatus claimed in claim 11, a passageway in said hub for receiving a support member and engaging said means for extending said electrical connection, and means for securing said hub and disc to said support member and for sealing said passageway.

13. In the apparatus claimed in claim 12, a support, a plurality of spaced rotatable shafts carried by said support with one shaft carrying said plating disc having said stack and another of said shafts carrying a second disc and having a hub, and means for rotating said shafts to unwind said stack and wind said strip on the hub of said second disc and said web and strip along different tangent lines to said stack for separating said web and strip.

14. The apparatus claimed in claim 6 in which said securing means comprises a loop integrally formed at one end of each module and a spring arm integrally formed at the opposite end of each module for passage through the loop of an adjacent module in the sequence.

15. A carrier strip for attachment to a web of variable length carrying a plurality of spaced contacts and having a plurality of spaced pilot holes therein, the improvement comprising:

a plurality of elongate modules each having spaced projections extending from one surface for engagement in one of said pilot holes to attach each module to said web, one groove formed adjacent the surface of each module opposite said one surface and spaced in registration with said projections to enable said projections to engage in said groove in response to the overlapping engagement of one module and attached web with another module attached to said web, and means for securing said modules in end to end relationship to form said carrier strip in a length corresponding to said web and for winding said strip and web in a stack with said one module and web overlapping said other module and web.

16. In the strip claimed in claim 15, a longitudinally extending rib on said one surface of each module, and a plurality of series of teeth spaced longitudinally on the opposite surface of each module to define said one groove for receiving said projections and a second groove for receiving a rib on another module with one series of teeth in registration with the space between said rib and projections and another series of teeth in registration with the space between the rib and one adjacent edge and a last series of teeth in registration with the space between each projection and the other edge adjacent said projections.

17. Contact plating apparatus for plating a selected variable plurality of contacts carried in spaced positions projecting from one edge of a web having spaced pilot holes extending to opposing surfaces of said web and corresponding in length to the selected plurality of contacts, the improvement comprising:

a plurality of elongate modules each formed of insulating material, securing means on each module for securing each module to another module to form an elongate carrier strip corresponding in length to the length of said web, a plurality of spaced projections on one surface of each module, a plating reel of insulating material, means for rotating said reel and automatically moving said strip and web in synchronism for engaging each of said spaced projections in a respective pilot hole to attach said carrier strip to said web while winding said strip and web on said reel in overlapping layers, and means on said strip for retaining each layer of said strip and web in registration on said reel.

18. A plating reel for carrying a web of variable length having a plurality of contacts projecting therefrom and an attached electrically insulating carrier strip having registration means for locating adjacent turns of said web and strip in registration in response to the winding of said web and strip on said reel for suspension from a plating shaft in a plating bath to plate the contacts projecting from said web, the improvement comprising:

an insulating disc, an insulating hub extending axially from one surface of said disc, means on said hub for engaging said registration means to wind a first turn of said web and strip in registration on said hub whereafter successive turns of said web and strip wound on said hub are retained in registration by said registration means with said contacts projecting axially in a direction from said disc, means in said hub for receiving said plating shaft and for extending an electrical connection from said shaft to the first turn of said web, and means for securing the last turn of said web and strip to said disc at any one of a plurality of positions spaced radially of said disc.

19. The plating reel as claimed in claim 18 in which said shaft extends axially through said hub, and means for securing said hub to said shaft and sealing said plating shaft from engagement with said plating bath.

20. A method for supporting a variable batch of contacts in a plating bath comprising the steps of:

forming said contacts in sequence at spaced positions on a web with said contacts projecting past one edge of the web, attaching a plurality of elongate modules each formed of insulating material in end to end relationship to form a carrier strip of a selected length, attaching said strip in overlapping relationship to said web while winding said strip and web in overlapping layers on a plating reel with said strip and web in registration and said contacts projecting axially in one direction past one edge of said strip and said web.

21. In the method claimed in claim 20, the step of attaching the opposite ends of said web to said reel.

22. In the method claimed in claim 21, the step of extending an electrical circuit to the opposite ends of said web.

23. In the method claimed in claim 21, the step of suspending said reel with said contacts projecting axially therefrom in the direction of the surface of a plating bath, and controlling the level of the surface of said plating bath relative said contacts.

24. In the method claimed in claim 20, the step of engaging said reel with a shaft utilized for extending an electrical circuit from said shaft to said contacts, and the step of securing said reel to said shaft while sealing said shaft from said bath.

25. In the method claimed in claim 20, the step of unwinding said strip and web from said reel onto respective other reels for separating said strip and web with all of said reels carried by a common support and said strip wound upon one of said other reels.

26. In the method claimed in claim 25, the step of locating the one other reel on which said separated strip is wound on a common support with said plating reel while rotating said plating reel to wind said strip and attached carrier thereon and unwind said strip from said one other reel.

* * * * *